US009517824B1

(12) United States Patent
Rondeau et al.

(10) Patent No.: US 9,517,824 B1
(45) Date of Patent: Dec. 13, 2016

(54) WATERCRAFT

(75) Inventors: Pierre Rondeau, St-Denis-de-Brompton (CA); Sam Spade, Palm Bay, FL (US); Philippe Petit, Orford (CA); Christopher Rudwal, Outremont (CA); Benoit Larose, Mont-Saint-Hilaire (CA); Simon Erpelding, Magog (CA); Andre Lettre, Granby (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 254 days.

(21) Appl. No.: 13/222,554

(22) Filed: Aug. 31, 2011

(51) Int. Cl.
*B63B 29/00* (2006.01)
*B63H 20/06* (2006.01)

(52) U.S. Cl.
CPC ..... *B63H 20/06* (2013.01)

(58) Field of Classification Search
CPC ..... B63H 20/06; B63B 3/08; B63B 7/04
USPC ..... 114/271, 292, 343, 364, 363
See application file for complete search history.

(56) References Cited

U.S. PATENT DOCUMENTS 1,597,303 A * 8/1926 Wade ..... 114/352
2,605,733 A 8/1952 Smith
2,650,376 A 9/1953 Sommer
2,659,464 A 11/1953 Sweetman
3,019,755 A * 2/1962 Diamond ..... 114/274
3,266,067 A 8/1966 Windle
3,426,724 A * 2/1969 Jacobson ..... B63B 1/18 114/55.51
3,614,938 A 10/1971 Statile
3,628,204 A * 12/1971 Hoffman, Jr. ..... 114/343
3,684,139 A 8/1972 Johnson
3,744,071 A 7/1973 Bossler
3,816,865 A 6/1974 Ragan
3,822,427 A 7/1974 Ewart
3,849,982 A * 11/1974 Hall ..... 60/221
3,878,806 A 4/1975 Garcia
3,965,513 A 6/1976 Horiuchi
3,996,634 A 12/1976 Grind
(Continued)

FOREIGN PATENT DOCUMENTS

AU 776164 B2 8/2004
EP 875447 A1 11/1998
(Continued)

OTHER PUBLICATIONS

English abstract of FR2898329 Billiotte et al., Sep. 14, 2007.

*Primary Examiner* — Edwin Swinehart
(74) *Attorney, Agent, or Firm* — BCF LLP

(57) ABSTRACT

A watercraft kit includes a watercraft and a buoyant removable rear extension optionally connected to a rear of the watercraft. The watercraft includes a hull having a transom and a deck disposed above the hull. The deck is supported by the hull. A propulsion system is operatively connected to an engine for expelling a stream of water rearward of the transom to propel the watercraft. When the removable extension is connected to the rear of the watercraft, the removable rear extension is disposed at least in part rearwardly of the transom. The removable rear extension defines a longitudinal channel. When the removable extension is connected to the rear of the watercraft, the channel receives at least one of at least a portion of the propulsion system, and at least a portion of the stream of water flowing therethrough when the propulsion system is operating to propel the watercraft forwardly.

18 Claims, 7 Drawing Sheets

(56) References Cited

U.S. PATENT DOCUMENTS

| | | | | | |
|---|---|---|---|---|---|
| 4,052,761 | A | | 10/1977 | Rilling | |
| 4,320,713 | A | | 3/1982 | Nishida | |
| 4,366,769 | A | | 1/1983 | Lingeman | |
| 4,478,167 | A | | 10/1984 | Hart | |
| 4,522,145 | A | | 6/1985 | Stone | |
| 4,671,202 | A | | 6/1987 | Johnson | |
| 4,718,587 | A | | 1/1988 | Roberts | |
| 4,807,549 | A | | 2/1989 | Rhodes | |
| 4,813,365 | A | * | 3/1989 | Lindstrom et al. | 114/271 |
| 4,827,865 | A | | 5/1989 | Yelderman | |
| 4,841,900 | A | | 6/1989 | Maselko | |
| 4,903,626 | A | * | 2/1990 | Haines | 114/291 |
| 4,936,238 | A | | 6/1990 | Childress | |
| 5,050,517 | A | | 9/1991 | Kobayashi | |
| 5,224,436 | A | * | 7/1993 | Stricker | 114/274 |
| 5,261,346 | A | | 11/1993 | Updyke | |
| 5,301,629 | A | | 4/1994 | Kleyh et al. | |
| 5,329,074 | A | * | 7/1994 | Alexander | 181/235 |
| 5,355,826 | A | * | 10/1994 | Hattori et al. | 114/55.57 |
| 5,870,965 | A | | 2/1999 | Hansen | |
| 5,937,564 | A | * | 8/1999 | Perreault | 43/4.5 |
| 6,059,618 | A | * | 5/2000 | Purnell et al. | 440/38 |
| 6,116,182 | A | * | 9/2000 | Koyanagi | 114/362 |
| 6,145,465 | A | | 11/2000 | Murphree | |
| 6,325,013 | B1 | | 12/2001 | Brown | |
| 6,325,014 | B1 | | 12/2001 | Blanchard | |
| 6,345,581 | B2 | | 2/2002 | Blanchard | |
| 6,505,571 | B1 | | 1/2003 | Critchfield et al. | |
| 6,637,362 | B1 | | 10/2003 | Avidiya | |
| 7,121,909 | B1 | | 10/2006 | Meyerhoffer | |
| 7,179,142 | B2 | * | 2/2007 | Fuse | B63B 35/731 114/55.5 |
| 7,395,773 | B1 | | 7/2008 | Finefield | |
| 7,610,870 | B1 | | 11/2009 | Zaseybida | |
| 7,856,937 | B2 | | 12/2010 | Chapdelaine et al. | |
| 8,261,683 | B2 | * | 9/2012 | Knoblett et al. | 114/363 |
| 8,459,198 | B2 | * | 6/2013 | Kilgore | 114/271 |
| D726,633 | S | * | 4/2015 | Cote | D12/307 |
| 2006/0130726 | A1 | | 6/2006 | Tyler | |

FOREIGN PATENT DOCUMENTS

| | | | |
|---|---|---|---|
| EP | 945336 | A1 | 9/1999 |
| FR | 2898329 | A1 | 9/2007 |
| WO | 8705273 | A1 | 9/1987 |
| WO | 9211181 | A1 | 7/1992 |
| WO | 2004089737 | A1 | 10/2004 |
| WO | 2005097589 | A1 | 10/2005 |

* cited by examiner

WATERCRAFT

TECHNICAL FIELD

The present invention relates to watercraft.

BACKGROUND

Recreational watercraft are designed to accommodate up to a certain number of passengers. For example, straddle-type personal watercraft (PWC) usually accommodate a driver and either one or two passengers seated behind the driver. As a consequence, a two-passenger vessel will generally require a longer body than a one-passenger vessel in order to fit a longer seat.

Given that most PWC hulls are molded as a single piece, a particular PWC model offered in both one-passenger and two-passenger versions will typically require two different hulls and two different decks. As such, the tooling and manufacturing costs are high.

Also, a user wanting to have both a one-passenger vessel and a two-passenger vessel has to own the two different watercraft. Similarly, a passenger wanting to upgrade from a one-passenger vessel to a two-passenger vessel would have to purchase a second vessel to replace the first. At least some of these issues could also be relevant for vessels accommodating more than two passengers.

Therefore, there is a need for a watercraft that would allow greater manufacturing flexibility.

SUMMARY

It is an object to ameliorate at least some of the inconveniences present in the prior art.

In one aspect of the present a watercraft kit is provided. The watercraft kit comprises a watercraft comprising a hull having a transom. A deck is disposed above the hull. The deck is supported by the hull. An engine is connected to at least one of the hull and the deck. A propulsion system is operatively connected to the engine for expelling a stream of water rearward of the transom to propel the watercraft. A buoyant removable rear extension is optionally connected to a rear of the watercraft. When the removable extension is connected to the rear of the watercraft, the removable rear extension is disposed at least in part rearwardly of the transom, the removable rear extension defining a longitudinal channel. When the removable extension is connected to the rear of the watercraft, the channel receives at least one of at least a portion of the propulsion system, and at least a portion of the stream of water flowing therethrough when the propulsion system is operating to propel the watercraft forwardly.

In an additional aspect, the removable rear extension is optionally connected to at least one of a rear of the deck and a rear of the hull.

In a further aspect, the removable rear extension includes a deck portion optionally connected to the rear of the deck. A hull portion is optionally connected to the rear of the hull. The deck portion and the hull portion are connected to each other. The deck portion receives an edge of the rear of the deck. The hull portion receives an edge of the rear of the hull.

In an additional aspect, when the hull portion is connected to the rear of the hull, a bottom surface of a front of the hull portion is substantially vertically aligned with a bottom surface of the rear of the hull.

In a further aspect, when the removable rear extension is connected to the rear of the watercraft, the removable rear extension abuts the transom.

In an additional aspect, at least a portion of a front face of the removable rear extension is shaped to be congruent with the transom.

In a further aspect, portions of the hull portion disposed laterally outwardly of the channel form at least two compartments.

In an additional aspect, the removable rear extension includes at least two foam inserts disposed inside the removable rear extension.

In a further aspect, a rear face of the removable rear extension is tapered.

In an additional aspect, the deck further comprises a pedestal. The watercraft further comprises a straddle seat supported by the pedestal.

In a further aspect, the straddle seat extends rearwardly from the pedestal.

In an additional aspect, the straddle seat is selected from a first straddle seat having a first length and a second straddle seat having a second length. The second length is greater than the first length. A pedestal extension is optionally connected to the pedestal. The pedestal is supporting the first straddle seat when the pedestal extension is not connected to the pedestal. The pedestal and the pedestal extension are supporting the second straddle seat when the pedestal extension is connected to the pedestal.

In a further aspect, a steering assembly for steering the watercraft is provided. The steering assembly is angularly steering the stream of water expelled by the propulsion system between a maximum port steering position and a maximum starboard steering position. The stream of water passes through the channel when the stream of water is steered at the maximum port and starboard steering positions.

In an additional aspect, the propulsion system further includes a ride plate, and a width of the channel is substantially equal to a width of the ride plate.

In a further aspect, the propulsion system includes a jet pump.

In an additional aspect, the channel is laterally aligned with a tunnel of the propulsion system.

In another aspect of the present a buoyant rear extension for removably connecting to a rear of a watercraft is provided. The rear extension comprises a top surface, and a bottom surface defining a channel. Tthe channel is adapted to receive at least one of at least a portion of a propulsion system of the watercraft and at least a portion of a stream of water expelled by the propulsion system rearwardly of the watercraft when the propulsion system is in operation. The channel is disposed laterally between two compartments. The two compartments are formed between the top and bottom surfaces. At least one of the top surface and the bottom surface includes an attachment portion for connecting the rear extension to the rear of the watercraft.

In an additional aspect, the top surface is at least one of U-shaped and substantially flat.

In a further aspect, the attachment portion includes at least one flange adapted to connect to the rear of the watercraft.

In an additional aspect, at least one foam insert disposed inside each of the two compartments.

In a further aspect, at least one foam insert is disposed vertically between the top surface and the bottom surface.

In yet another aspect of the present a system for assembling a family of watercraft is provided. The system comprises first components for assembling a first watercraft. The first components include a hull having a transom. A deck is disposed above the hull. The deck is supported by the hull. An engine is connected to at least one of the hull and the deck. A propulsion system is operatively connected to the engine for expelling a stream of water rearward of the transom to propel the watercraft. Second components for assembling a second watercraft include the hull having the transom. The deck is disposed above the hull. The deck is supported by the hull. The engine is connected to at least one of the hull and the deck. The propulsion system is operatively connected to the engine for expelling a stream of water rearward of the transom to propel the watercraft. A buoyant removable rear extension is removably connected to a rear of the watercraft. The removable rear extension is disposed at least in part rearwardly of the transom. The removable rear extension is defining a longitudinal channel. The channel is receiving at least one of at least a portion of the propulsion system, and at least a portion of the stream of water flowing therethrough when the removable rear extension is connected to the rear of the watercraft and the propulsion system is operating to propel the watercraft forwardly. When the first watercraft is assembled using the first components, the deck has a first length and the hull has a second length. When the second watercraft is assembled using the second components, the deck has a third length greater than the first length, and the hull has a fourth length greater than the second length.

In yet another aspect of the present a system for assembling a family of watercraft is provided. The system comprises first components for assembling a first watercraft. The first components include a hull having a transom. A deck is disposed above the hull. The deck is supported by the hull. The deck has a pedestal. A first seat is supported by the pedestal. The first seat has a first length. An engine is connected to at least one of the hull and the deck. A propulsion system is operatively connected to the engine. Second components for assembling a second watercraft include the hull having the transom. The deck is disposed above the hull. The deck is supported by the hull. The deck has the pedestal. A second seat has a second length greater than the first length. The engine is connected to at least one of the hull and the deck. The propulsion system operatively connected to the engine. A pedestal extension is removably connected to a rear of the pedestal. The pedestal and the pedestal extension are supporting the second seat. The first watercraft is assembled using the first components. The second watercraft is assembled using the second components.

For purposes of this application, terms related to spatial orientation such as forwardly, rearwardly, left, and right, are as they would normally be understood by a user, a rider or a driver of the vehicle sitting thereon in a normal riding position.

Embodiments of the present invention each have at least one of the above-mentioned object and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
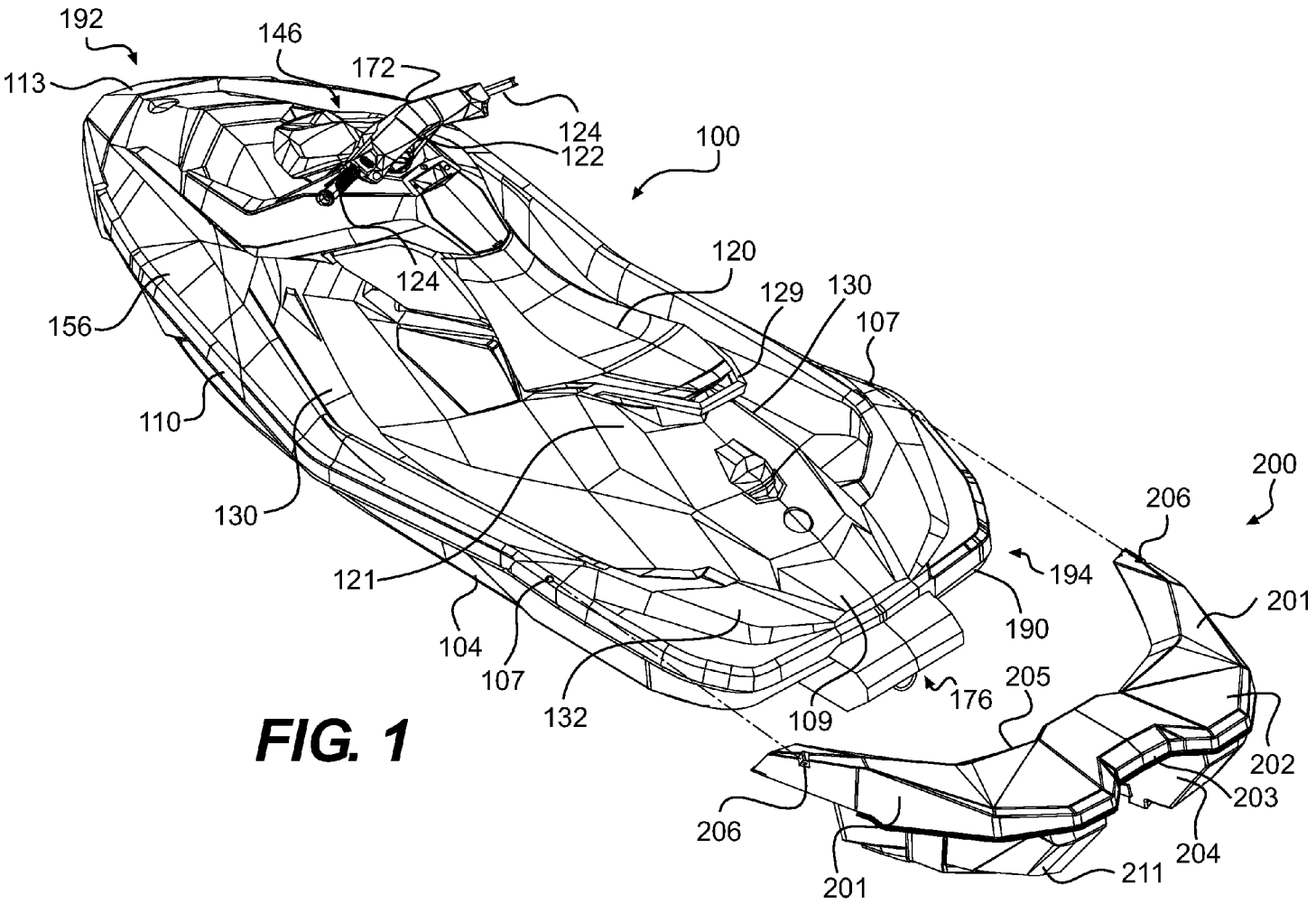
FIG. 1 is a perspective view, taken from a rear, top, left side of a personal watercraft shown with an embodiment of a rear extension disconnected from the personal watercraft.
Figure 2:
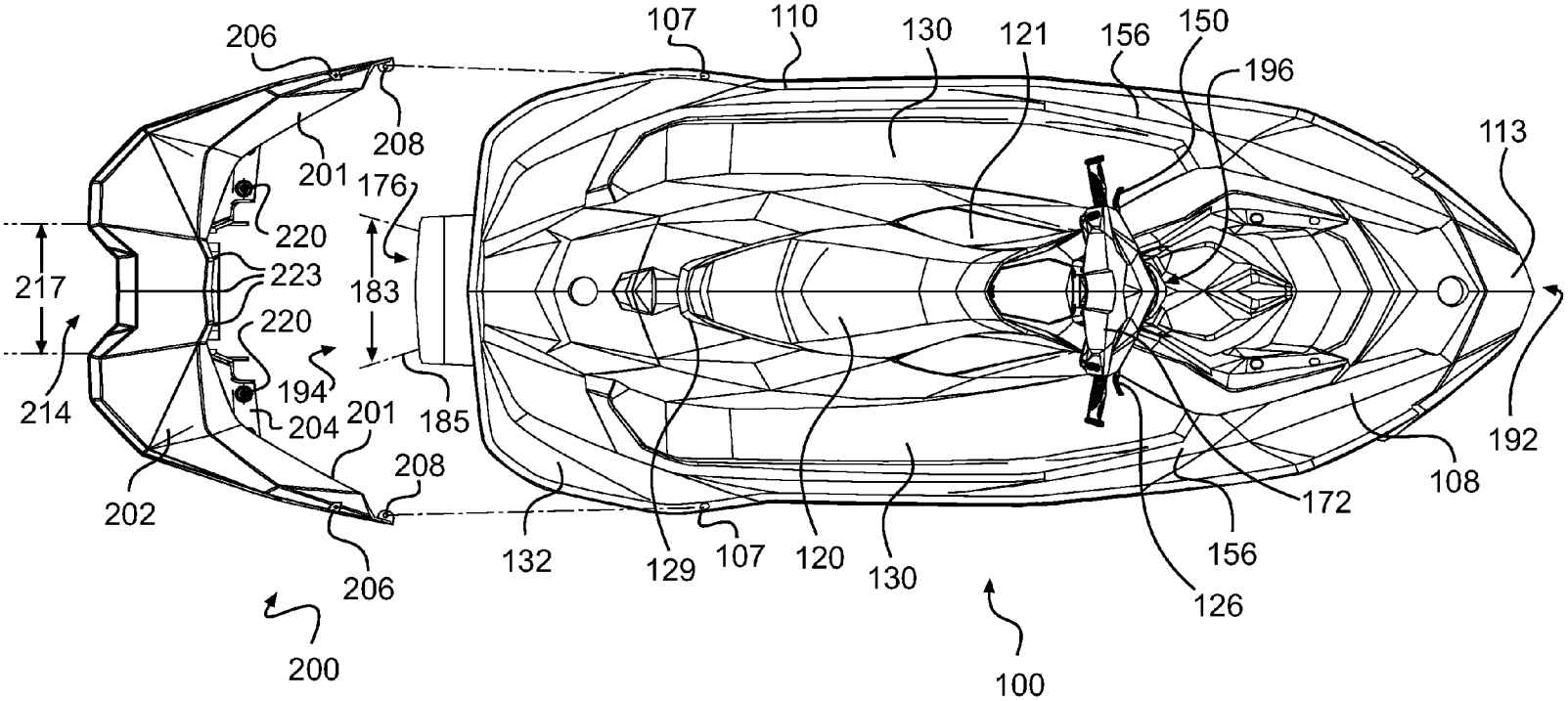
FIG. 2 is a top plan view of the personal watercraft and the rear extension of FIG. 1 with the rear extension disconnected from the personal watercraft.

Referring to FIGS. 1 to 4, a personal watercraft (hereinafter called watercraft) 100 having a rear extension 200 optionally connected thereto will be described. Although, the rear extension 200 is described herein in use with a personal watercraft, it is contemplated that a rear extension similar to the rear extension 200 could be used on watercraft other than a personal watercraft. For example, a rear extension could be used on a sports boat.

The personal watercraft 100 is made of a hull 104 and a deck 108 disposed on the hull 104. The hull 104 buoyantly supports the watercraft 100 in the water. The deck 108 and the hull 104 are each made of a unitary piece of thermoplastic. The thermoplastic is a composite of propylene and a filler. It is also contemplated that the deck 108 and/or the hull 104 could be made of more than one piece. It is also contemplated that when the deck 108 and/or the hull 104 are made of more than one piece, some or all of the pieces could be made of different materials.

The hull 104 and deck 108 are joined together at a bond line (not shown) by fasteners. It is contemplated that the hull 104 and deck 108 could be joined together at the bond line by way other than with the fasteners. For example, an adhesive may be used to join the hull 104 to the deck 108. A bumper 110 covers the bond line, which helps to prevent damage to an outer surface of the watercraft 100 when the watercraft 100 is docked. It is contemplated that the bumper 110 could be omitted. A front 192 of the watercraft 100 includes a front bumper 113. The volume created between the hull 104 and the deck 108 is referred to as the engine compartment. The engine compartment accommodates an engine 112 as well as other elements required by or desired for the watercraft 100.

The deck 108 has a pedestal 121 on top of which a straddle seat 120 is centrally positioned. The straddle seat 120 accommodates the driver in a straddling position and a single passenger. The pedestal 121 is integrally formed with the deck 108. It is contemplated that the pedestal 121 could be fastened to the deck 108. It is contemplated that the pedestal 121 could be removably connected to the deck 108. A pedestal extension 300 (shown in FIG. 7) is removably connected to a rear of the pedestal 121 for extending a length of the pedestal 121 thereby providing additional support to a straddle seat 120' which is longer than the straddle seat 120. The pedestal extension 300 will also be described below. It is contemplated that the pedestal extension 300 could be omitted.

The straddle seat 120 is removably attached to the pedestal 121 and a grab handle 129 by a hook and tongue assembly (not shown) at a front of the straddle seat 120 and by a latch assembly (not shown) at the rear of the straddle seat 120. It is contemplated that the straddle seat 120 could be attached to the pedestal 121 by other attachment mechanisms. It is also contemplated that the straddle seat 120 could not be removable. The straddle seat 120 covers an access opening to a compartment. The grab handle 129 is provided between the pedestal 121 and the straddle seat 120 at a rear of the straddle seat 120 to provide a handle onto which a passenger may hold on.

The watercraft 100 has a pair of generally upwardly extending walls, known as gunwales or gunnels 156, located on either side of the watercraft 100. The gunnels 156 help to discourage the entry of water in the watercraft 100, provide lateral support for the driver's feet, and also provide buoyancy when turning the watercraft 100. Optionally, the gunnels 156 could extend inwardly to act as heel rests towards the transom 190 of the watercraft 100.

Located on either side of the straddle seat 120, between the pedestal 121 and the gunnels 156, are a pair of footrests 130. The footrests 130 are designed to accommodate the driver's feet in various riding positions. The footrests 130 are covered by carpeting made of a rubber-type material to provide additional comfort and feet traction for the rider. It is contemplated that the carpeting could be omitted.

A reboarding platform 132 is provided at the transom 190 of the watercraft 100 to allow the rider or a passenger to easily reboard the watercraft 100 from the water. Carpeting may also cover the reboarding platform 132.

The rear extension 200 shown disconnected from the watercraft 100 in FIGS. 1 to 4 is optionally connected to the transom 190 of the watercraft 100 to increase, among other things, the surface of the reboarding platform 132 available to the passengers. By "optionally connected", it should be understood that the rear extension 200 could be removed from the watercraft 100, and that the watercraft 100 is an operational watercraft with and without the rear extension 200. The rear extension 200 will be described below.

A helm assembly 146 is positioned forwardly of the straddle seat 120. The helm assembly 146 includes a steering column 122, and a pair of steering handles 124. A central helm portion 172 of the helm assembly 146 is padded. It is contemplated that the padding could be omitted. The right steering handle 124 is provided with a throttle lever 126 allowing the rider to control the speed of the watercraft 100, and the left steering handle 124 with a lever 150 to control a position of a reverse gate 187 (shown in FIG. 5). The reverse gate 187 will be described below. It is contemplated that the lever 150 and the reverse gate 187 could be omitted. Optional display clusters could be located on the helm assembly 146. The helm assembly 146 is also provided with a key receiving post (not shown), located near a center of the central helm portion 172. The key receiving post is adapted to receive a key attached to a lanyard so as to allow starting of the watercraft 100. It is contemplated that the key receiving post may be placed in any other suitable location on the watercraft 100.

Figure 4:
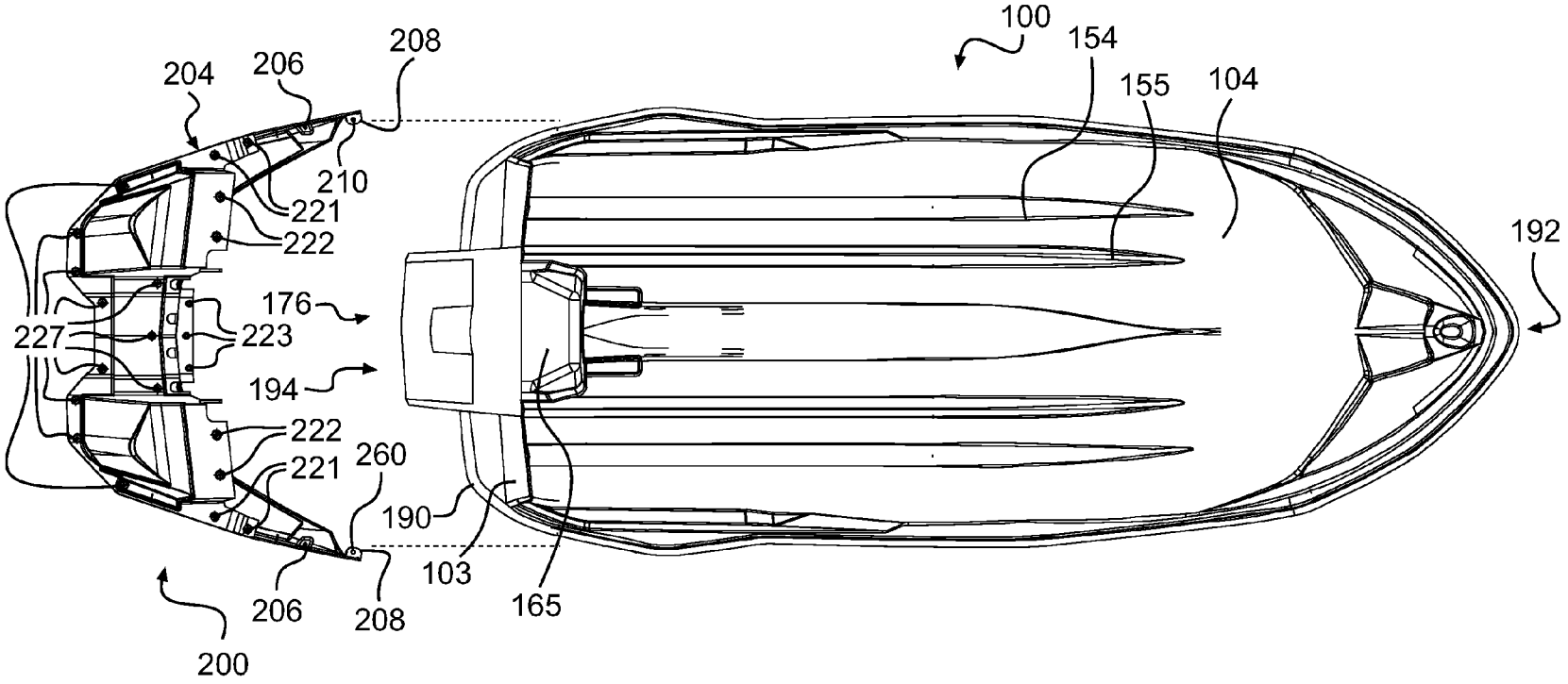
FIG. 4 is a bottom plan view of the personal watercraft and the rear extension of FIG. 1 with the rear extension disconnected from the personal watercraft.

As best shown in FIG. 4, the hull 104 is provided with a combination of strakes 154 and chines 155. A strake 154 is a protruding portion of the hull 104. A chine 155 is the vertex formed where two surfaces of the hull 104 meet. The combination of strakes 154 and chines 155 gives the watercraft 100 its riding and handling characteristics.

Sponsons 70 (only one being shown in FIG. 3) are located on either sides of the hull 104 near the transom 160. The sponsons 70 have an arcuate undersurface, which give the watercraft 100 both lift while in motion and improved turning characteristics.

Figure 5:
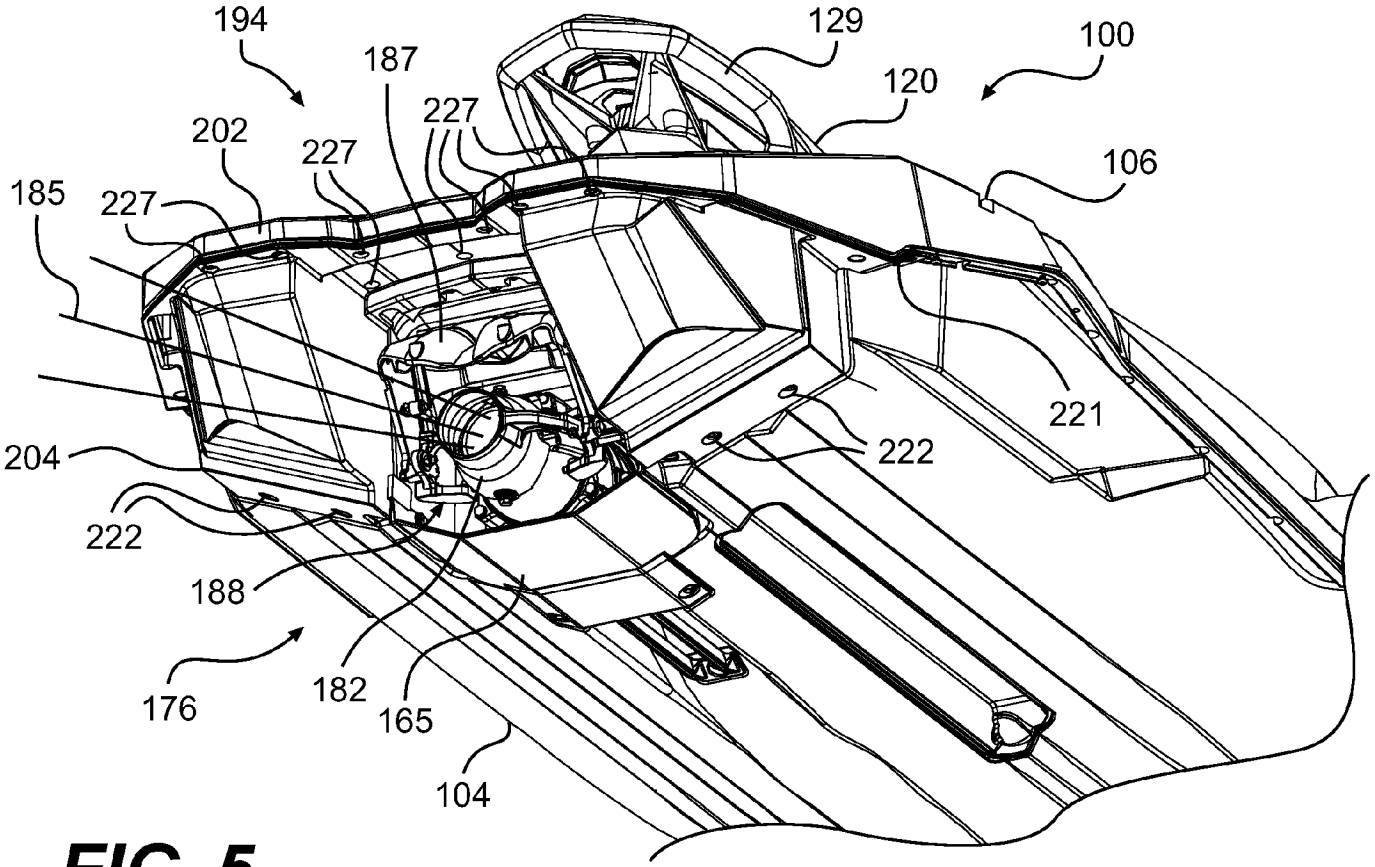
FIG. 5 is a perspective view taken from a bottom, rear, right side of a rear portion of the personal watercraft and the rear extension of FIG. 1 with the rear extension connected from the personal watercraft.

Turning now to FIG. 5, the watercraft 100 is propelled by a jet propulsion unit 176. It is contemplated that other types of propulsion systems, such as propellers, could also be used. The jet propulsion unit 176 pressurizes water and accelerates it into a stream of water or jet 185 to create thrust. The water is first scooped from under the hull 104 through an inlet grate (not shown). The inlet grate prevents large rocks, weeds, and other debris from entering the jet propulsion unit 176 since they may damage it or negatively affect its performance. Water then flows through a water intake ramp (not shown). The top portion of the water intake ramp is preferably formed by hull 104, and the ride shoe (not shown) forms its bottom portion. Alternatively, the intake ramp may be a single piece to which the jet propulsion unit 176 attaches. In such cases, the intake ramp and the jet propulsion unit 176 are attached as a unit in a recess in the bottom of hull 104. From the intake ramp, water then enters the jet propulsion unit 176. The jet propulsion unit 176 is located in what is known as the tunnel 188. The tunnel 188 is opened towards the rear, and is defined at the front, sides, and top by the hull 104, and at the bottom by a ride plate 165. The ride plate 165 is the surface on which the watercraft 100 rides or planes. The jet propulsion unit 176 is made of two main parts: the impeller (not shown) and the stator (not shown). The impeller is coupled to the engine 112 by one or more shafts, such as a driveshaft and an impeller shaft. The rotation of the impeller pressurizes the water, which then moves over the stator that is made of a plurality of fixed stator blades (not shown). The role of the stator blades is to decrease the rotational motion of the water so that most of the energy imparted to the water is used for thrust, as opposed to swirling the water. Once the water leaves the jet propulsion unit 176, it goes through the pump nozzle. Since the pump nozzle's exit diameter is smaller than its entrance diameter, the water is accelerated further, thereby providing more thrust. A steering nozzle 182 is pivotally attached to the pump nozzle through a vertical pivot point. The steering nozzle 182 is operatively connected to the helm assembly 146 via a push-pull cable (not shown) such that when the helm assembly 146 is turned, the steering nozzle 182 pivots, redirecting the water coming from the pump nozzle, so as to steer the watercraft 100 in the desired direction. In some watercraft, the steering nozzle 182 may be gimbaled to allow it to move around a second, horizontal pivot axis. The up and down movement of the steering nozzle 182 provided by this additional pivot axis is known as trim, and controls the pitch of the watercraft 100.

The reverse gate 187 is pivotally attached to the sidewalls of the tunnel 188. It is contemplated that the reverse gate 187 could be connected directly on the pump's nozzle instead of the steering nozzle 182. To make the watercraft 100 move in a reverse direction, the rider pulls on the lever 150 (shown in FIG. 2) operatively connected to the reverse gate 187. The reverse gate 187 then pivots in front of the steering nozzle 182 and redirects the water leaving the jet propulsion unit 176 towards the front of the watercraft 100, thereby thrusting the watercraft 100 rearwardly. It is contemplated that the reverse gate 187 could be omitted.

Figure 6:
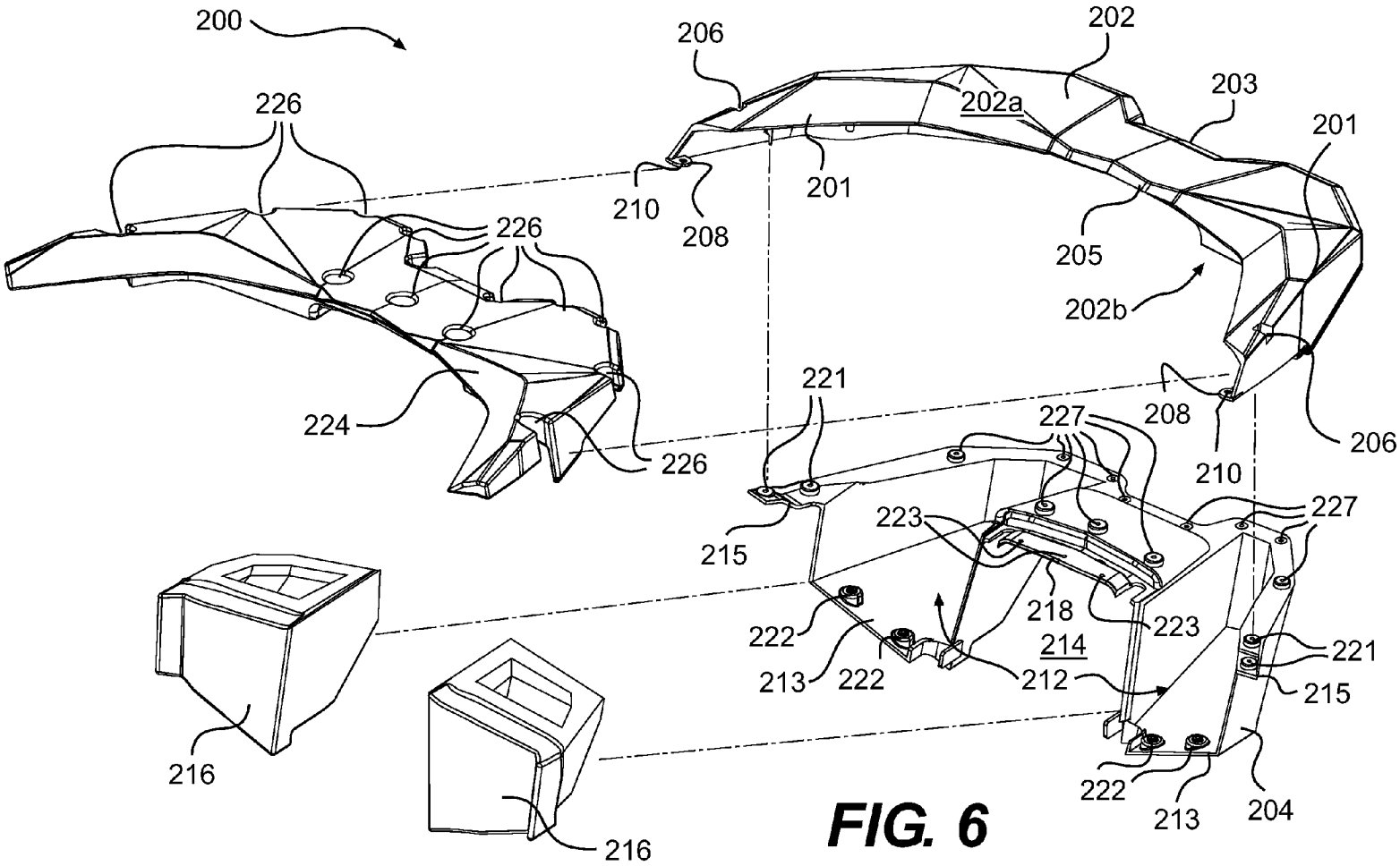
FIG. 6 is an exploded view of the rear extension for the watercraft of FIG. 1.

Turning now to FIG. 6, the rear extension 200 will be described.

The rear extension 200 is a buoyant extension, removably and optionally connected to a rear 194 of the watercraft 100 at the transom 190. As such, the watercraft 100 and the rear extension 200 form a kit. When added to the watercraft 100, the rear extension 200 lengthens the watercraft 100 by providing both an extension to the hull 104 and to the deck 108. Thus, the rear extension 200 combined with the watercraft 100 form a system for assembling family of watercraft, with longer watercraft when the rear extension 200 is connected to the watercraft 100, and shorter watercraft when the rear extension 200 is disconnected to the watercraft 100. It is contemplated that the rear extension 200 could be adapted to provide only an extension to the hull 104 or only an extension to the deck 108. As mentioned above, the rear extension 200 could be removed from the watercraft 100, and that the watercraft 100 could nonetheless be an operational watercraft.

The rear extension 200 includes a deck portion 202 and a hull portion 204. The deck portion 202 and the hull portion 204 are each made of a unitary molded piece of thermoplastic. The deck portion 202 is made of the same thermoplastic as the deck 108. The hull portion 204 is made of the same thermoplastic as the hull 104. It is contemplated that the deck portion 202 and the hull portion 204 could be made of a material different from a thermoplastic. It is also contemplated that the deck portion 202 could be made of a different material from the deck 108 and/or the hull portion 204 could be made of a different material from the hull 104. It is also contemplated that each of the deck portion 202 and the hull portion 204 could be made of two or more portions. The deck portion 202 and the hull portion 204 are removably connected to each other. It is contemplated that the deck portion 202 and the hull portion 204 could be fixedly connected to each other. For example, the deck portion 202 and the hull portion 204 could be formed as a single integral piece.

The deck portion 202 will first be described. The deck portion 202 is substantially flat. The deck portion 202 is U-shaped (as seen above) and has two arms 201. When the rear extension 200 is connected to the watercraft 100, the two arms 201 of the U-shape extend forwardly along sides and top of a rear end 109 of the deck 108. The deck portion 202 has a height (not shown) similar to a height of the deck 108. When connected to the watercraft 100, the deck portion 202 overlaps with the rear end 109 of the deck 108. It is contemplated that the deck portion 202 could not be substantially flat. It is contemplated that the two arms 201 could be omitted. It is contemplated that the deck portion 202 could be flush with the deck 108. It is contemplated that the watercraft 100 could not have the reboarding platform 132, and that the deck portion 202 could be directly connected to the deck 108 so as to form a reboarding platform.

The portion of the deck portion 202 that overlaps the reboarding platform 132 at the rear end 109 is designed to provide minimal instep with the rear 109 of the deck 108. A front edge 205 of the deck portion 202 has a shape determined to be congruent with bottoms of raised portions of the reboarding platform 132 so that the deck portion 202 comes flush with the deck 108 when the rear extension 200 is connected to the watercraft 100. It is contemplated that the deck portion 202 could not be designed to have a minimally visible transition with the deck 108.

The deck portion 202 also has an indentation 203 at a rear end thereof. The indentation 203 is disposed above a channel 214 of the hull portion 204 and allows an upper portion of the jet 185 to minimally interfere with the rear extension 200. It is contemplated that the indentation 203 could be omitted. It is also contemplated that the indentation 203 could have a shape different from the one shown in the Figures.

The deck portion 202 is bolted to the deck 108 via two apertures 206 which mate with two corresponding apertures 107 of the deck 108. Each aperture 206 is located in a corresponding one of the arms 201. It is contemplated that the deck portion 202 could have more or less than two apertures 206 so as to mate with more or less than two apertures 107. The deck portion 202 has two side flanges 208 disposed at front ends of the arms 201. The side flanges 208 extend downwardly and inwardly from the arms 201. When the rear extension 200 is connected to the watercraft 100, the two side flanges 208 abut against the hull 104 underneath the bumper 110 so that a portion of the bumper 110 is wrapped by the side flanges 208. Each side flange 208 has an aperture 210 for receiving a bolt (not shown) for bolting the deck portion 202 to the hull 104. The use of the side flanges 208 descreases the number of connections points of the deck portion 202 visible from a top of the watercraft 100. It is contemplated that the side flanges 208 could be disposed elsewhere on the deck portion 202. It is contemplated that more or less than two apertures 206 could connect the deck portion 202 to the deck 108. It is also contemplated that the side flanges 208 could be omitted. It is contemplated that the side flanges 208 could have no apertures 210. It is contemplated that the deck portion 202 could have more than two side flanges 208. It is also contemplated that the deck portion 202 could only be secured to the deck 108 or could only be secured to the hull 104. It is also contemplated that the deck portion 202 could be connected to the hull 104 by way other than bolting. It is also contemplated that the deck portion 202 could be connected to the hull portion 204 and that only the hull portion 204 could be connected to the watercraft 100.

A bottom surface 202*b* of the deck portion 202 has a plurality of hollow pegs (not shown) which extend downwardly therefrom. The hollow pegs receive bolts for connecting the hull portion 204 to the deck portion 202. Thanks to the hollow pegs, a connection between the deck portion 202 and the hull portion 204 is non apparent on a top surface 202*a* of the deck portion 202, which provides an aesthetically pleasant result. It is contemplated that the hollow pegs could be omitted. It is contemplated that the deck portion 202 could have apertures extending through the deck portion 202 instead of the hollow pegs, such that the connection between the deck portion 202 and the hull portion 204 would be apparent on the top surface 202*a* of the deck portion 202.

The hull portion 204 will now be described. The hull portion 204 is congruent with the transom 190 when connected to the watercraft 100. The hull portion 204 extends vertically from about the bumper 110 to a bottom of the transom 190 so that a bottom surface 225 of the hull portion 204 is substantially vertically aligned with a rear 103 of the hull 104. The hull portion 204 has a height 219 (shown in FIG. 3) similar to a height 111 (shown in FIG. 3) of the transom 190. The bottom surface 225 (shown in FIG. 3) of the hull portion 204 is slightly upwardly tapered. When the watercraft 100 is at planning speeds, a portion of the hull portion 204 will contact a body of water the watercraft 100 is operating in, thereby lengthening the surface on which the watercraft 100 planes beyond the ride plate 165 so as to further support the watercraft 100 having the rear extension 200 connected thereto. It is also contemplated that the hull portion 204 could not contact the water during planning. The hull portion 204 is at least partially submerged when the watercraft 100 is at rest or travelling at low speeds. A rear face 211 of the hull portion 204 is downwardly tapered. It is contemplated, however, that when the watercraft 100 is at planning speeds, the hull portion 204 could contact the body of water. It is also contemplated that the bottom surface 225 could not be upwardly tapered. It is contemplated that the rear face 211 could be tapered more or less than shown in the Figures.

Figure 3:
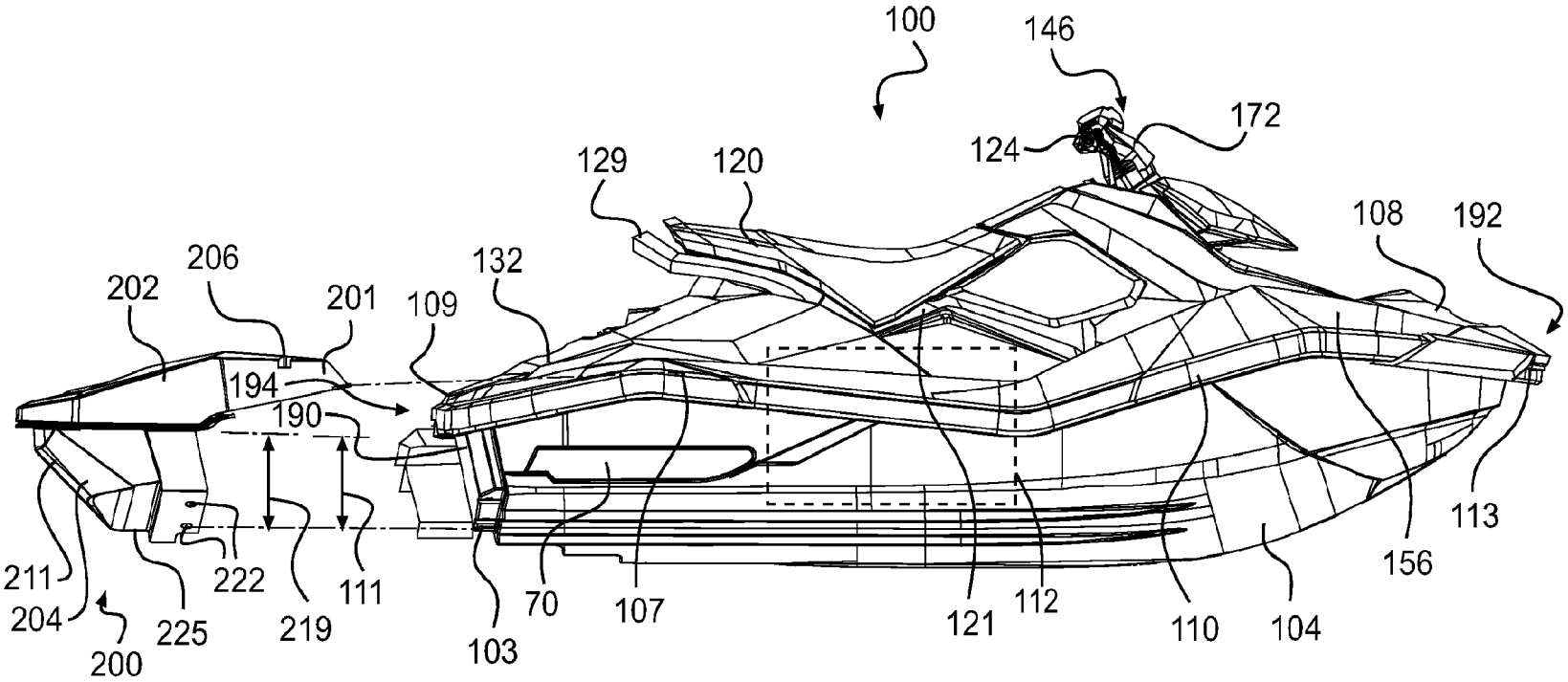
FIG. 3 is a right side elevation view of the personal watercraft and the rear extension of FIG. 1 with the rear extension disconnected from the personal watercraft.

The hull portion 204 has a plurality of apertures 227 to mate with the hollow pegs of the deck portion 202. Bolts inserted in the apertures 227 are threaded to a threaded portion of the hollow pegs for connecting the deck portion 202 to the hull portion 204. The hull portion 204 is removably bolted to the rear 103 (shown in FIG. 3) of the hull 104 via two flanges 213. Two apertures 222 are disposed on each of the flanges 213. As best seen in FIG. 3, when the hull portion 204 is connected to the hull 104, the flanges 213 overlap the rear 103 of the hull 104, such that when the hull portion 204 is connected to the hull 104, the hull portion 204 comes flush with a rest of the hull 104. It is contemplated that the rear 103 could not form a shoulder in the hull 104. It is also contemplated that the hull portion 204 could form a step with the rest of the hull 104 when connected to it. It is contemplated that the flanges 213 could be omitted. It is contemplated that the hull portion 204 could have more or less than two apertures 222 per flange 213.

The hull portion 204 is removably bolted to the hull 104 at an underside of the bumper 110 via two side flanges 215. Two apertures 221 are disposed on each of the flanges 215. The apertures 221 mate with apertures (not shown) of the hull 104 for connection thereto. It is contemplated that the hull portion 204 could have more or less than two apertures 221 per flange 215. It is contemplated that the hull portion 204 could also be connected directly to the deck 108. For example, the deck portion 202 could have upwardly extending side flanges for connecting to the deck 108. It is also contemplated that the deck portion 202 could have more or less apertures 221 than shown in the Figures.

Three apertures 223 are disposed on a flange 218. The flange 218 is disposed at a front of the hull portion 204. These apertures 223 are used to removably bolt the hull portion 204 to an underside of the jet propulsion unit 176. It is contemplated that the hull portion 204 could have more or less than three apertures 223.

The hull portion 204 includes a channel 214 that defines two compartments 212. The channel 214 is laterally aligned with the tunnel 188 of the jet propulsion unit 176. The channel 214 accommodates a portion of the jet propulsion unit 176, and allows the jet 185 expelled from the jet propulsion unit 176 to minimally interfere with the rear extension 200. The channel 214 is wide enough to accommodate various positions at which the jet 185 is expelled from the steering nozzle 182. In particular, a width 217 (shown in FIG. 2) at a rear of the channel 214 is greater than a width 183 (shown in FIG. 2) between the outer most edges of the jet 185 turned at its maximum port and starboard steering portions measured at a distance from the hull corresponding to a rear of the channel 214. As such, the jet 185 passes within the channel 214 with no or minimal interference regardless of a steering position of the jet 185. The width 217 of the channel 214 corresponds to a width of the ride plate 165. It is contemplated that the rear extension 200 could have more than one channel 214. For example, the rear extension 200 could have as many channels 214 as there are propulsion units on the watercraft 100. It is also contemplated that in some watercraft, the channel 214 could not accommodate the jet propulsion unit 176. For example, the jet propulsion unit 176 could be longitudinally flush with or recessed from the transom 190 of the watercraft 100 and the channel 214 could only accommodate a portion of the jet 185. It is also contemplated that in other watercraft, the channel 214 could not receive the jet 185. For example, the rear extension 200 could be longitudinally flush with the jet propulsion unit 176 of the watercraft 100 and the channel 214 could only accommodate a portion of the jet propulsion unit 176.

As best seen in FIG. 6, the compartments 212 have an open top and an open front. The compartments 212 each receive a foam insert 216. The foam inserts 216 are made of Styrofoam®. The foam inserts 216 provide buoyancy to the rear extension 200. The foam inserts 216 are dimensioned to fit snuggly inside their respective compartment 212. The foam inserts 216 are hollow, bucket-shaped. It is contemplated that the compartments 212 of the hull portion 204 could have a shape different from shown in the Figures. It is also contemplated that each compartment 212 could receive more than one foam insert 216. It is also contemplated that each compartment 212 could not have the foam insert 216 and that buoyancy of the rear extension 200 could be achieved by way other than the foam inserts 216. It is also contemplated that the foam inserts 216 could not be hollow. It is also contemplated that the foam inserts 216 could be removed and the compartments 212 made watertight. It is contemplated that the compartments 212 with or without the foam inserts 216 could provide a storage space. For example, a panel hinged at a top of the rear extension 200 could be used to access one or both of the storage compartments. Items such as ropes or beverages could be stored in the storage compartment.

The rear extension 200 also includes a flat foam insert 224. The flat foam insert 224 is disposed vertically between the deck portion 202 and the hull portion 204. The flat foam insert 224 has substantially the shape of the deck portion 202. The flat foam insert 224 provides some stiffness to the rear extension 200, in particular above the channel 214. Such stiffness is desired to accommodate the one or more passengers that may stand, reboard or sit on the rear extension 200 when the watercraft 100 is in operation. The flat foam insert 224 has rims (not shown) on an underside thereof that are pressed against the foam inserts 216 which seal the rear extension 200 to help prevent water from flowing into the compartments 212. The top side of each foam insert 216 being open, the rim is pressed against the open top of the foam insert 216. The bucket foam inserts 216 and lid foam insert 224 reduces weight and cost. Furthermore, the sealed foam inserts 216 and 224 alleviate the need for a seal between the deck and hull portions 202 and 204. Were water to leak inside the rear extension 200, the foam inserts 224 and 216 would prevent infiltration and retention of any amount of water significant enough to affect buoyancy. It is contemplated that a seal could connect the deck and hull portions 202 and 204 together. The flat foam insert 224 is made of polypropylene, having a density of approximately 1.3 lbs/ft$^3$. The flat foam insert 224 has a plurality of apertures and indentations 226 which mate with the hollow pegs of the deck portion 202 and the corresponding apertures 227 of the hull portion 204 so as to allow connecting bolts to pass therethrough. It is contemplated that the deck portion 202 and the hull portion 204 could be sealingly connected to each other and that the flat foam insert 224 could be omitted. It is contemplated that the flat foam insert 224 could be made of two or more pieces. It is also contemplated that the flat foam insert 224 could alternatively be made of another buoyant material, such as closed cell foam. It is also contemplated that instead of a flat foam insert 224, the cavity within the extension 200 could be filled with an inflated balloon-like vessel. It is contemplated that the space between the deck portion 202 and the hull portion 204 be filled by a single foam insert.

To connect the rear extension 200 to the watercraft 100, the deck portion 202 is first connected to the hull portion 204. To do so, if not previously done, the foam inserts 216 are inserted into their respective compartments 212, and the flat foam insert 224 is disposed on top of the hull portion 204 and pressed onto the foam inserts 216 so as to close the hollow space therewithin. The apertures 226 are aligned with the apertures 227. The deck portion 202 is then disposed onto the assembly formed by the flat foam insert 224 and the hull portion 204, making the apertures 227 coincide with the hollow pegs. Using bolts, the deck portion 202 is fastened to the hull portion 204 via the apertures 227. Once assembled, the rear extension 200 is disposed at the rear 194 of the watercraft 100, by sliding the side flanges 208 onto the bumper 110 until the apertures 206 coincide with the apertures 107 of the deck 108. The deck portion 202 is then bolted to the watercraft 100 at the apertures 206 and 210, and the hull portion 204 at the apertures 222 and 223. Either one of the deck portion 202 and the hull portion 204 can be bolted first to the watercraft 100. It is contemplated that the arms 201 and the flange 218 could be resilient and be able to deform slightly as the rear extension 200 is positioned around the rear 194 of the watercraft 100. Alternatively, the deck and hull portions 202, 204 can first be connected to the deck 108 and hull 104 respectively, before the deck 202 and hull 204 portions are connected together.

To remove the rear extension 200 from the watercraft 100, the bolts at the apertures 206 and 210 are removed so as to free the deck portion 202, and similarly the bolts at the apertures 222 and 223 are removed so as to free the hull portion 204. The rear extension 200 is then slid out of the rear 194 of the watercraft 100. It is contemplated that the rear extension 200 could be connected to the watercraft 100 during assembly of the watercraft 100, such that the rear extension 200 may not be removed once assembled to the watercraft 100.

Figure 7:
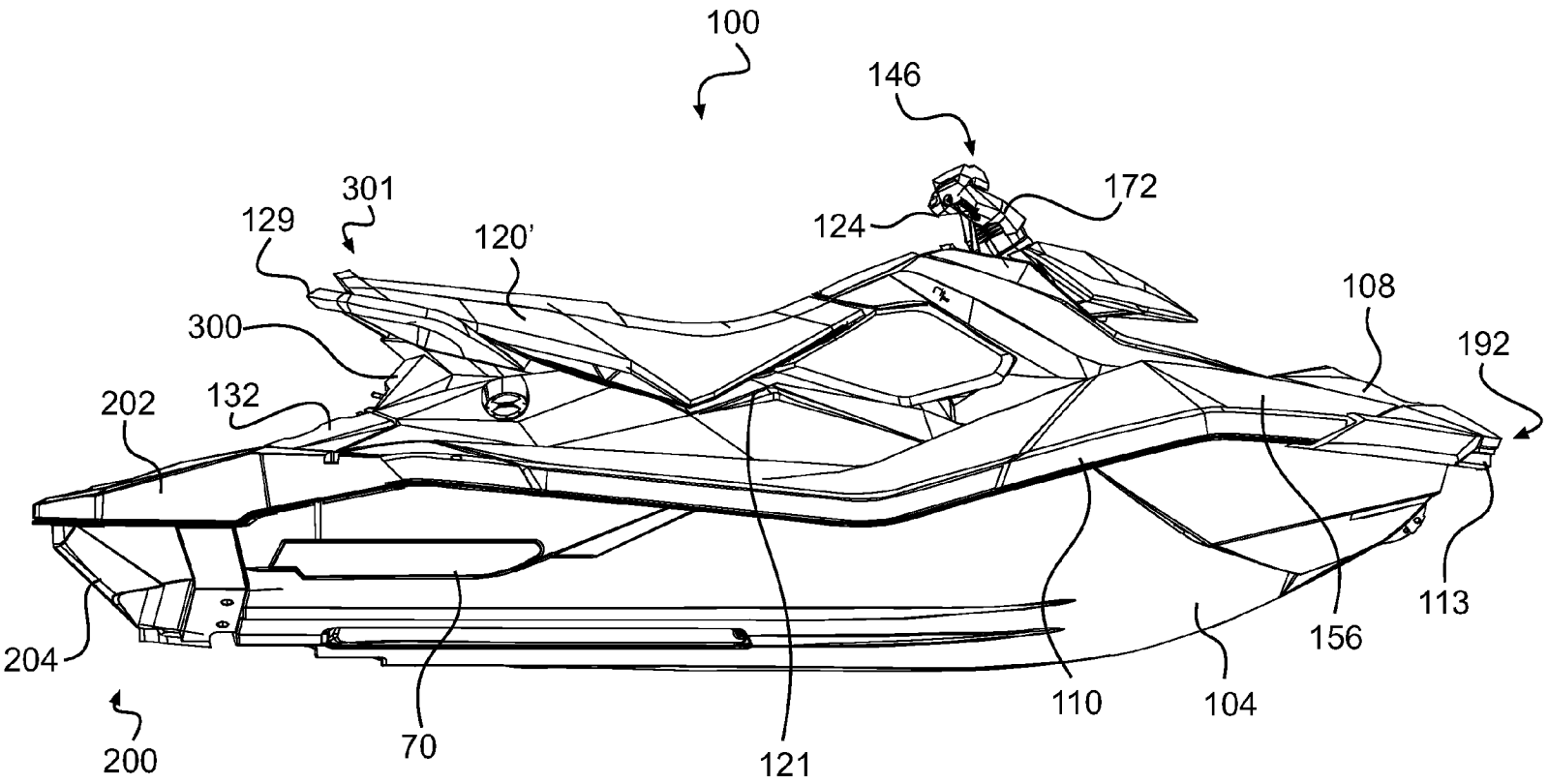
FIG. 7 is a right side elevation view of the personal watercraft with the rear extension of FIG. 1 connected to the watercraft shown with a pedestal extension and a straddle seat longer than the one shown in FIG. 1.

Turning now to FIG. 7, a pedestal extension 300 will be described. The pedestal extension 300 is a removable element optionally connected to the rear of the pedestal 121. When the pedestal extension 300 is connected to the pedestal 121, the pedestal 121 and the pedestal extension 300 together form a pedestal assembly 301 which allows the watercraft 100 to provide support for the straddle seat 120'. As mentioned above, the straddle seat 120' is longer than the straddle seat 120. The straddle seat 120' is mounted above the pedestal assembly 301. It is contemplated that that even without the pedestal extension 300, the watercraft 100 may still be able to support the longer straddle seat 120', depending on the construction of the straddle seat 120' and the pedestal 121. Similarly to the straddle seat 120, the straddle seat 120' is removably connected to the pedestal assembly and the handle 129 by a hook and tongue assembly (not shown) at a front of the straddle seat 120' and by a latch assembly (not shown) at the rear of the straddle seat 120'. It is contemplated that the straddle seat 120' could be attached to the pedestal assembly by other attachment mechanisms.

The pedestal extension 300 has a front face congruent and abutting with a rear of the pedestal 121. The pedestal extension 300 has apertures (not shown) which mate with apertures (not shown) in the pedestal 121 for removably bolting the pedestal extension 300 to the pedestal 121. The watercraft 100 also includes a bracket (not shown) disposed below the deck 108 and extending upwardly from an inside of the hull 104 to support a load of the seat at the location of the pedestal extension 300. The grab handle 129 is removably bolted to the pedestal 121, such that it can be removed from the pedestal 121 and bolted onto the pedestal assembly formed by the pedestal extension 300 for use with the straddle seat 120' when the pedestal extension 300 is connected to the pedestal 121. Alternatively, the grab handle 129 is fastened to the straddle seat 120 and the straddle seat 120' has a similar handle fastened thereto, such that the seats and the handles are installed and removed together.

To adapt the watercraft 100 for use with the straddle seat 120', the grab handle 129 and the straddle seat 120 are disconnected from the pedestal 121. The hook and tongue assembly and the latch assembly, which connect the straddle seat 120 to the pedestal 121 and the grab handle 129, are first disengaged so as to enable removing of the straddle seat 120. The grab handle 129 can then be detached from the pedestal 121. The pedestal extension 300 is then disposed at the rear of the pedestal 121 and secured thereto using bolts. The grab handle 129 is connected to the pedestal extension 300 and the straddle seat 120' is connected to both the pedestal 121 and the pedestal extension 300. It will be appreciated however that various other arrangements for securing the seats 120 and 120', and the grab handle 129 are within the scope of the present invention.

In order to use the watercraft 100 with the straddle seat 120 when the watercraft 100 has the straddle seat 120', the seat 120' is first disconnected from the pedestal assembly formed by the pedestal 121 and the pedestal extension 300, followed by the grab handle 129. The pedestal extension 300 can then be unbolted from the pedestal 121. The grab handle 129 is then bolted to the pedestal 121 and the straddle seat 120 is connected to the pedestal 121. The grab handle 129 can first be bolted to the pedestal 121 or the hook and tongue assembly and the latch assembly of the straddle seat 120 can first be connected to the pedestal 121.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull having a transom;

a deck disposed above the hull, the deck being supported by the hull, the hull and the deck defining an engine compartment therebetween, the deck comprising a pedestal;

an engine disposed in the engine compartment forward of the transom;

a propulsion system operatively connected to the engine for expelling a stream of water rearward of the transom to propel the watercraft, the propulsion system including a jet pump;

a straddle seat supported by the pedestal, the straddle seat being selected from a first straddle seat having a first length and a second straddle seat having a second length, the second length being greater than the first length; and a buoyant removable rear extension optionally connected to a rear of the watercraft, the first straddle seat being selected when the rear extension is removed from the rear of the watercraft, the second straddle seat being selected when the rear extension is connected to the rear of the watercraft, when supported by the pedestal, the second straddle seat extending further rearward than the first straddle seat supported by the pedestal, when connected to the rear of the watercraft, the removable rear extension being disposed at least in part rearwardly of the transom, at least a bottom surface of the removable rear extension forming a substantially continuous surface with the hull, the removable rear extension defining a longitudinal channel, the channel receiving at least one of:

at least a portion of the propulsion system, and at least a portion of the stream of water flowing through the propulsion system when the propulsion system is operating to propel the watercraft forwardly.

2. The watercraft of claim 1, wherein the removable rear extension is optionally connected to at least one of a rear of the deck and a rear of the hull.

3. The watercraft of claim 2, wherein the removable rear extension includes:

a deck portion optionally connected to the rear of the deck; and a hull portion optionally connected to the rear of the hull, the deck portion and the hull portion being connected to each other, the deck portion receiving an edge of the rear of the deck, and the hull portion receiving an edge of the rear of the hull.

4. The watercraft of claim 3, wherein a bottom surface of a front of the hull portion is substantially vertically aligned with a bottom surface of the rear of the hull.

5. The watercraft of claim 1, wherein the removable rear extension abuts the transom.

6. The watercraft of claim 5, wherein at least a portion of a front face of the removable rear extension is shaped to be congruent with the transom.

7. The watercraft of claim 1, wherein portions of the removable rear extension disposed laterally outwardly of the channel form at least two compartments.

8. The watercraft of claim 1, wherein the removable rear extension includes at least two foam inserts disposed inside the removable rear extension.

9. The watercraft of claim 1, wherein a rear face of the removable rear extension is tapered.

10. The watercraft of claim 1, wherein the straddle seat extends rearwardly from the pedestal.

11. The watercraft of claim 1, further comprising a pedestal extension optionally connected to the pedestal, the pedestal supporting the first straddle seat when the pedestal extension is not connected to the pedestal, the pedestal and the pedestal extension supporting the second straddle seat when the pedestal extension is connected to the pedestal.

12. The watercraft of claim 1, further comprising a steering assembly for steering the watercraft, the steering assembly angularly steering the stream of water expelled by the propulsion system between a maximum port steering position and a maximum starboard steering position; and wherein the stream of water passes through the channel when the stream of water is steered at the maximum port and starboard steering positions.

13. The watercraft of claim 1, wherein the propulsion system further includes a ride plate, and a width of the channel is substantially equal to a width of the ride plate.

14. The watercraft of claim 1, wherein the channel is laterally aligned with a tunnel of the propulsion system.

15. A method of assembling a watercraft comprising:

providing a hull having a transom;

disposing a deck above the hull, the deck being supported by the hull, the deck having:

a pedestal, a left gunnel disposed on a left side of the pedestal, a left footrest disposed laterally between the left gunnel and the pedestal, a right gunnel disposed on a right side of the pedestal, and a right footrest disposed laterally between the right gunnel and the pedestal, the hull and the deck defining an engine compartment therebetween;

disposing one of a first seat and a second seat on the pedestal laterally between the left and right footrests, the first seat having a first length, the second seat having a second length greater than the first length;

disposing a helm assembly at least in part forward of the one of the first seat and the second seat;

disposing an engine in the engine compartment forward of the transom;

operatively connecting a propulsion system to the engine; and removably connecting a pedestal extension to a rear of the pedestal for providing additional support to the second seat, the pedestal supporting the first seat without the pedestal extension when the first seat is disposed on the pedestal;

selectively disposing the first seat on the pedestal when the pedestal extension is removed from the pedestal; and selectively replacing the first seat with the second seat and the pedestal extension, the pedestal extension being removably connected to the pedestal and extending rearwardly therefrom, the second seat being disposed on the pedestal and the pedestal extension, when disposed on the pedestal and the pedestal extension, the second seat extending further rearward from the pedestal than the first seat disposed on the pedestal.

16. The method of claim 15, further comprising removably connecting a buoyant removable rear extension to at least one of a rear of the hull and a rear of the deck when the second seat is disposed on the pedestal.

17. A method of assembling a watercraft, the watercraft comprising:

a hull having a transom;

a deck disposed above the hull, the deck being supported by the hull, the hull and the deck defining an engine compartment therebetween, the deck having a pedestal;

an engine disposed in the engine compartment forward of the transom;

a propulsion system operatively connected to the engine; and a helm assembly disposed on the deck forward of the pedestal, the method comprising:

disposing one of a first seat and a second seat on the pedestal at least in part rearward of the helm assembly, the first seat having a first length, the second seat having a second length greater than the first length;

removably connecting a buoyant removable rear extension to at least one of a rear of the hull and a rear of the deck;

selectively disposing the first seat on the pedestal when the rear extension is removed from the at least one of the rear of the hull and the rear of the deck; and selectively replacing the first seat with the second seat on the pedestal when the rear extension is removably connected to at least one of the rear of the hull and the rear of the deck, when disposed on the pedestal, the second seat extending further rearward than the first seat disposed on the pedestal.

18. The method of claim 17, wherein at least a bottom surface of the removable rear extension forms a substantially continuous surface with the hull when the rear extension is connected to the one of the rear of the hull and the rear of the deck.

* * * * *